United States Patent [19]

Pagano et al.

[11] Patent Number: 4,516,375

[45] Date of Patent: May 14, 1985

[54] FRAMEWORK BLOCK OR BRICK CONSISTING OF MODULAR ELEMENTS OF FORMED SHEET STEEL OR ALUMINUM AND COMPRISING JOINTING MEANS

[76] Inventors: Michele Pagano, Parco Comola, 147-Napoli; Nicola Palumbo, Vico Belledonne a Chiaia, 9 Napoli, both of Italy

[21] Appl. No.: 458,848

[22] Filed: Jan. 18, 1983

[30] Foreign Application Priority Data

Jan. 29, 1982 [IT] Italy ..... 47691 A/82
Jul. 13, 1982 [IT] Italy ..... 35926/82[U]

[51] Int. Cl.[3] ..... E04C 1/10
[52] U.S. Cl. ..... 52/581; 52/650
[58] Field of Search ..... 52/581, 648, 650, 654

[56] References Cited

U.S. PATENT DOCUMENTS 3,829,999 8/1974 Bernstein ..... 52/648 X

FOREIGN PATENT DOCUMENTS 214193 3/1957 Australia ..... 52/648
2526660 12/1976 Fed. Rep. of Germany ..... 52/648
2745321 4/1978 Fed. Rep. of Germany ..... 52/581
1581815 9/1969 France ..... 52/356

*Primary Examiner*—Donald G. Kelly
*Assistant Examiner*—Naoko N. Slack
*Attorney, Agent, or Firm*—Staas & Halsey

[57] ABSTRACT

A framework block or brick consisting of modular elements of formed sheet steel or aluminum and having the shape of a rectangular parallelepiped comprising: two identical, pyramid-shaped elements symmetrically disposed and composed each of a rectangular base frame defining the facing surface of the walls and corner elements or ribs forming the four opposite semidiagonals of the brick which are connected to the corners of the base frame, and four angle bars having substantially a C-section and connected to the corners of the respective base frame and provided with holes for the connection of the blocks to one another by fastening means. The elements or ribs intersect in a flattened central portion provided with holes for the connection of said ribs and the elements to one another by fastening means.

5 Claims, 8 Drawing Figures

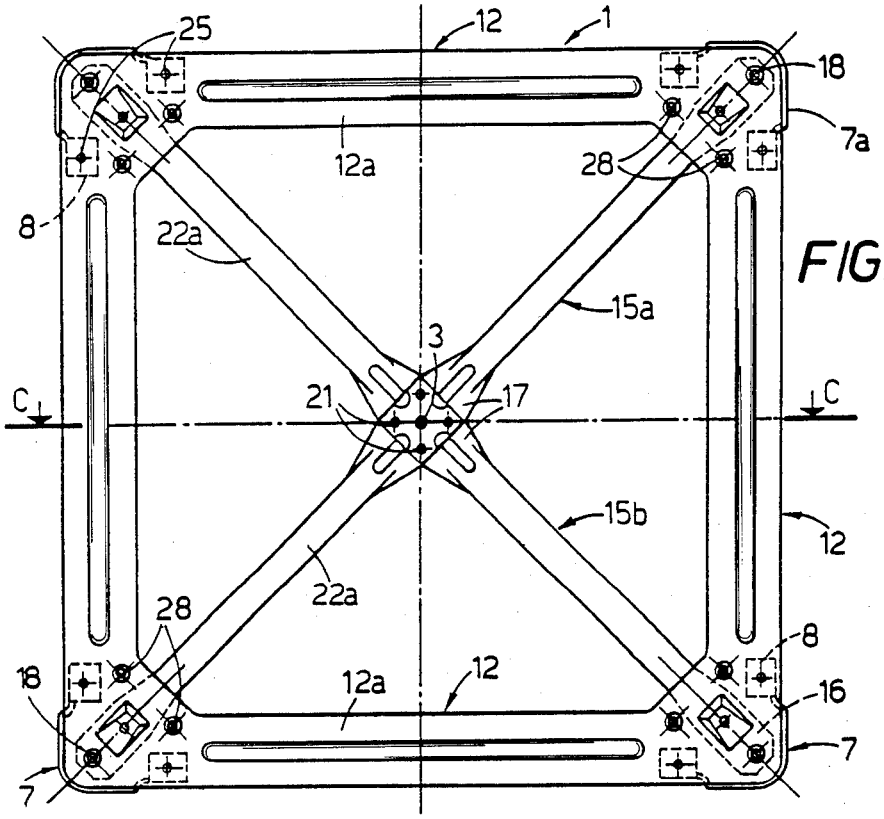
FIG. 3
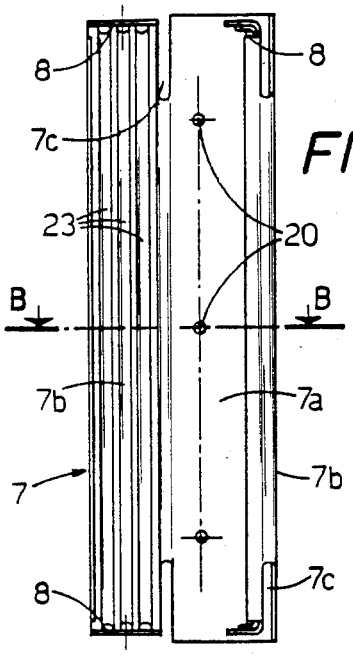
FIG. 4
FIG. 5
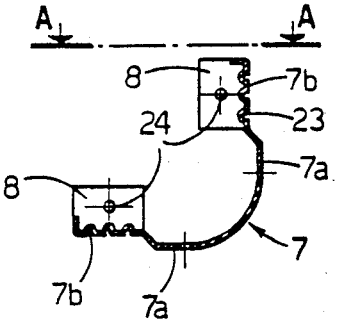

FRAMEWORK BLOCK OR BRICK CONSISTING OF MODULAR ELEMENTS OF FORMED SHEET STEEL OR ALUMINUM AND COMPRISING JOINTING MEANS

This invention relates to the field of civil engineering and concerns a parallelepiped block which will be called "brick" having a rectangular, particularly squared, base and a framework structure consisting of modular shaped elements composed of formed sheet steel or other material, non-ferrous too, such as aluminium or reinforced plastic or fiber glass. The framework block comprises a jointing means together with shaped joint covering plates which allows the bricks to be assembled for the construction of bearing walls and floors, wherein the bricks are used under shearing stress and are designed for varied applications either in the building or in other fields. Numerous reticular structures have been disclosed in known patents, for instance, like those registered under the trademark "MERO" and "UNISTRUT". Such patents mainly provide double-layer structures consisting of tubular or poligonal rods and jointing members which allow the connection in various directions thereof. However, these structures are adapted to large-span coverings with regular frame spaces on which continuous, flexible or metallic boards are placed providing for the right covering.

On the contrary, these structures are not suitable to civil constructions of the building type whereby the bearing structure is composed of vertical walls and horizontal floors having a thickness of the order of 30 cm. Thus, the above mentioned systems require microstructures, the rods and knots of which would be miniaturized causing a cost increase due to the high incidence of joints and rods and to the difficulty of construction. On the other hand it would be very difficult to place both continuous layers which however are needed either for the walls or for the floors. A modular assembly having a framework structure, socalled "brick", has been proposed in the past to provide for reticular construction means resembling the common bricks. This assembly comprises a subassembly preformed with rods and then reduces radically the number of the joints apart from the economical and technological advantages achieved by the bearing structure. The "brick" has the essential advantage of being the base element of a design for the whole building and the covering panels of the walls and floors as well. It should be noted that considerable advantages are achieved either from the eventual use in modular systems or the reduction of the construction time and the possibility to use the structures as trampling plane before finishing them.

According to the above mentioned system the brick, as modular element having a framework structure, is composed of formed sheet steel portions, i.e. two walls and four angle bars for the connection of the walls which are joined to one another by spot welding on each side of the brick.

The assembling is performed in factory owing to the extremely great difficulty of using a spot welder in the building yard where it is only performed the installation of the single bricks by interposing special joints therebetween.

This assembling and mounting method, however, has many troubles. In fact it is bound to the use of assembly jigs during the production (being otherwise impossible to position walls and angle bars during the assembling), extends the time of installation of the bricks, requires the insertion of the joints brick by brick and involves relevant difficulties of riveting. However, the greatest disadvantage which affects the cost of this metallic brick is bound to the transportation thereof in the assembled form from the factory to the building yard.

This causes high transportation costs due to the extremely unfavourable ratio volume/weight. The object of this invention is to provide a modular element having a framework structure such that it is generally the same as the above disclosed modular element, under operating conditions so that it may be still called "brick", but its configuration is such as to avoid the above mentioned troubles.

The sheet steel brick of this invention consists of a pair of square pyramid elements disposed with opposite vertices which are connected to each other by means of rivets at these vertices, the corners of the square pyramid bases being joined respectively by four angle bars, each angle bar as corner element acting as a joint at least between two adjacent bricks joined to each other by means of rivets.

Therefore the square pyramid element has the vertex beveled for the junction to the like element. Both joined elements together with the four corner angle bars provide a modular, parallelepiped framework block of formed sheet steel.

The pyramid elements are formed by blanking a steel sheet. To reduce the off-cuts, as well as to facilitate the forming operations and to provide economical dies, only the base frame of the pyramid element is formed from the steel sheet, while the central sheared part serves appropriately to form the corner angle bars. The corners of the pyramid elements are formed in two halves having a V-shape, whereby each V-shaped element forms two opposite semidiagonal and can be obtained from a press formed steel strip of suitable width involving no waste.

It is well understood that in comparison with the previous systems which provide separate joints and the spot welding of the walls to the angle bars, the present system needs advantageously a reduced number of components.

Furthermore the possibility of assembling the components in the building yard allows the bricks to be transported under disassembled configuration. Therefore walls and angle bars can be separately stacked and transported so as to allow for a space reduction and transport cost saving.

These and other features of the present invention as well as the advantages thereof will be readily evident from the following description of a preferred embodiment with reference to the accompanying drawing, in which:

FIG. 3 is a front view of the brick in assembled position;

FIG. 4 is an inner view of an angle bar in enlarged scale from the line A—A of FIG. 5;

FIG. 5 is the cross section along the line B—B of FIG. 4;

Figure 1:
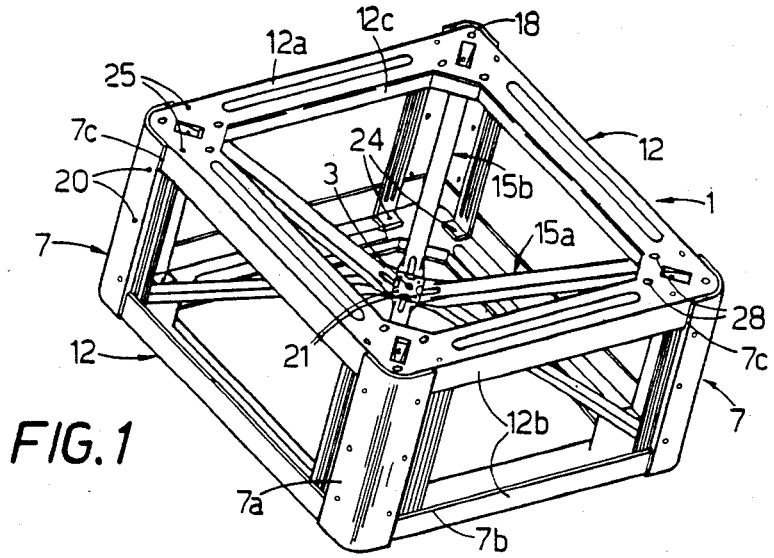
FIG. 1 is a perspective view of the finished block or brick.
Figure 6:
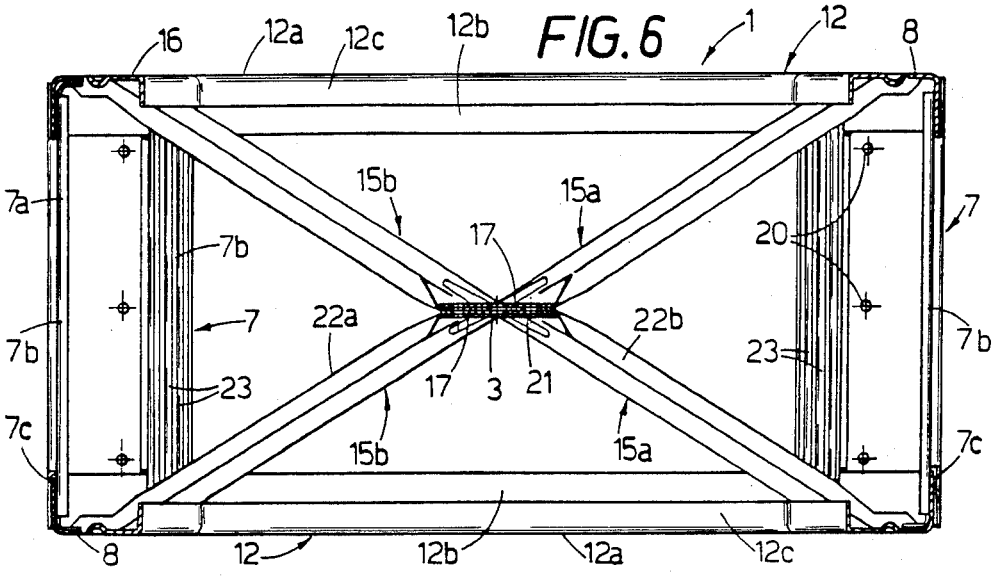
FIG. 6 is the horizontal, longitudinal section of the brick along the line C—C of FIG. 3.

Referring to the drawing, FIGS. 1, 3 and 6 show a finished block or brick.

Said block or brick generally consists of two pyramid-shaped, symmetrically placed elements 1 and four angle bars 7. The elements 1 and the angle bars 7 form in combination a parallelepiped block or brick having a rectangular base, in particular a square base, and provide a modular framework assembly formed from a sheet steel. This assembly consists particularly of a framework structure whose components are the corners of a parallelepiped body which are connected to one another by means of diagonals. The diagonals are formed in two halves which are separated by the symmetry plane parallel to the facing surfaces of the brick which is installed according to an edge-to-edge connection for the construction of walls. One half of the diagonals is made integral with one of the facing surface and the second half with the opposite one.

Figure 2:
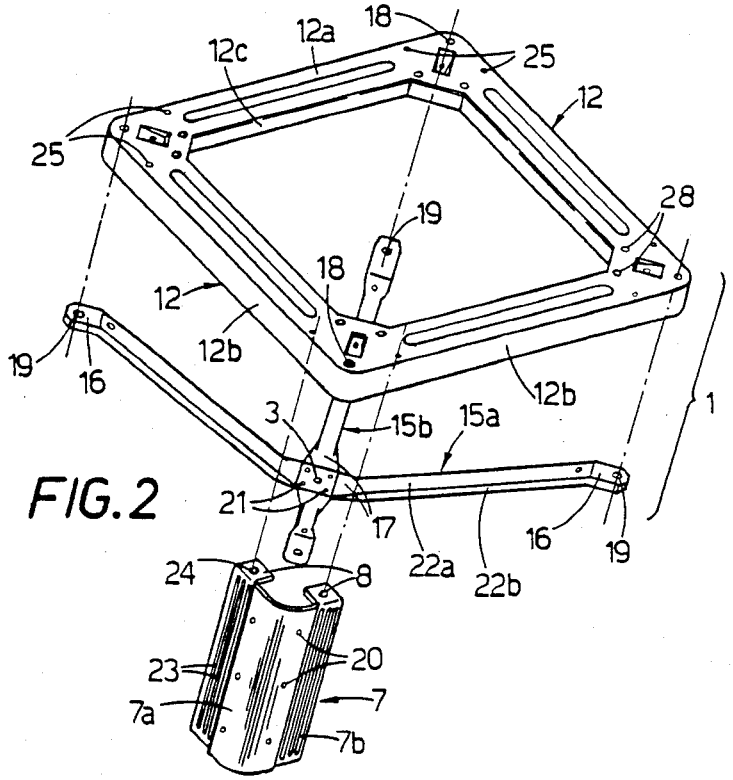
FIG. 2 is an exploded view of one of the component elements with a corner angle bar.

According to the present invention each pyramid element 1 including one facing surface consists of three portions and namely a base frame 12 of rectangular, particularly square, shape (FIGS. 1 and 2) and two V-shaped elements or ribs 15*a* and 15*b*, each of them extending like a pair of opposite semidiagonals of the finished brick. These elements or ribs 15*a* and 15*b* have flat ends 16 forming tabs which are bent of an angle such as to lie in the plane of the respective base frame 12, while at its top the V-shaped ribs 15*a* and 15*b* are also flattened in 17 so as to form an even joint portion parallel to the tabs 16. The tabs 16 engage in each corner of the base frames 12 in which a hole 18 is formed corresponding to a hole 19 formed in each tab 16 and designed to receive a screw or another jointing means to lock the ribs 15*a*, 15*b* to the respective base frames 12. A central hole 3 and other holes 21 are provided in the flattened top portion 17. The base frame 12 has substantially an U-section so as to provide at the facing surface of the brick an even band 12*a* connected to a longer external band 12*b* and a shorter internal band 12*c*, both perpendicular to the even band 12*a*. The external bands 12*b* of each side of the base frame 12 are connected to one another at the corners of the base frame 12, while the internal bands 12*c* are connected to one another by a straight length. Each base frame 12 is press formed after that the central portion corresponding to the central void of the respective facing surface has been removed from the steel sheet. This central portion of sheet steel is not to be considered a waste product, since the blank necessary to form the angle bars can be appropriately obtained therefrom. This decreases the fabrication cost and reduces the off-cuts. Furthermore, even if steel sheets of thin thickness are used, the production of the base frame 12 according to the present invention does not cause any trouble due to the deformation during the press forming.

The V-shaped elements or ribs 15*a* and 15*b* are produced separately from a sheet steel strip and have substantially an U-section for stiffening purposes with a central portion 22*a* connected to longitudinal rims 22*b* extending at right angle therefrom.

The angle bars 7 which forming the corner elements perpendicular to the facing surfaces of the base frames 12 have a height equal to the thickness of the walls to be constructed with the bricks of the present invention. Each angle bar 7 consists essentially of a C-shaped element having two flanges 7*a*, in which holes 20 longitudinally, aligned at predetermined distance from one another are formed. Each flange 7*a* extends with an edge portion 7*b* which is offset inwardly. In both transit regions of each angle bar 7 between the flanges 7*a* and their edge portions 7*b*, where the latter are offset inwardly, a cut 7*c* is provided on the upper and the lower sides of each edge portion 7*b*. The cuts 7*c* have a depth same as the width of the bands 12*b*. In the assembled position (FIG. 1) the corner portions of each band 12*b* are inserted in the cuts 7*c* so as to be placed inside the flanges 7*a* of each corner angle bar 7 and outside the edge portions 7*b* of the flanges 7*a*. The edge portions 7*b* can be provided with longitudinal stiffening ribs 23 by means of drawing operation Both edge portions 7*b* of each angle bar 7 extend at the upper and the lower sides with tabs 8 which are bent inwardly at right angle with respect to the edge portions 7*b*. A hole 24 is formed in each tab 8. The tabs 8 are designed to be inserted under the bands 12*a* of the base frame 12 which is provided with holes 25 aligned with the holes 24 in order to receive screws or other joint means to lock each angle bar 7 to the base frame 12 at the corner regions thereof.

Figure 7:
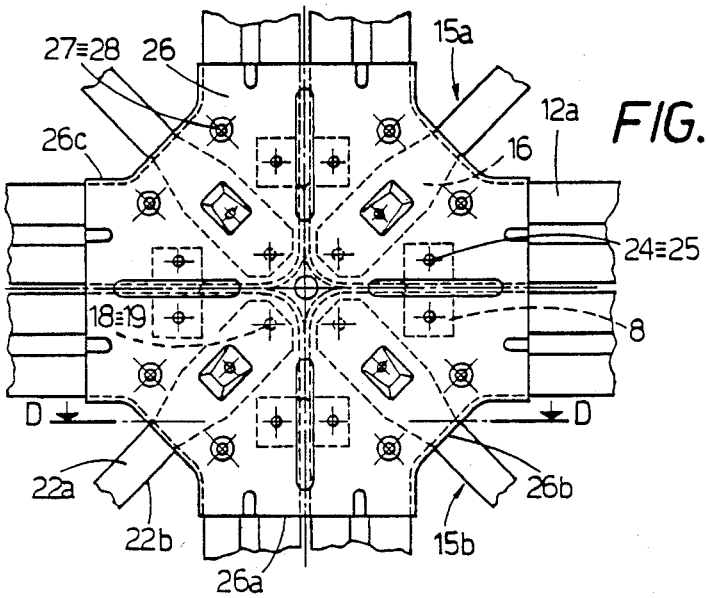
FIG. 7 shows the detail of a joint among four blocks or bricks in enlarged scale.
Figure 8:
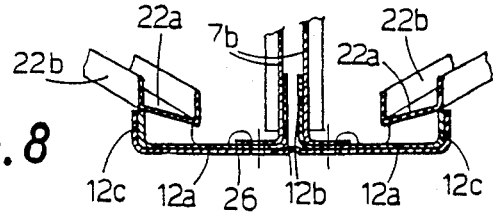
FIG. 8 is the vertical section along the line D—D of FIG. 7.

The metallic framework blocks or bricks are assembled as disclosed below. The V-shaped elements or ribs 15*a*, 15*b* are connected to each other by means of screws or other joint means passing through the holes 3 and 21 and then are secured to the respective base frame 12 by screws or the like through the holes 18, 19. The angle bars 7 are connected to the formed element 1 by suitable locking means passing through the holes 24 of the tabs 8 and through the holes 25 formed in the bands 12*a* of the base frame 12. The bricks can be assembled in horizontal rows by securing the angle bars 7 to one another by means of screws or the like passing through the coaxial pairs of holes 20 formed in adjacent flanges 7*a* lying in the vertical plane while the bricks of the upper row are coupled to those of the lower row by means of screws or the like passing through the coaxial pairs of holes 20 formed in adjacent flanges 7*a* lying in the horizontal plane. In FIG. 7 it is shown the detail of a connection among four bricks which have a contact corner and are laid one upon the other in two rows.

The connection is improved and shielded by a formed covering plate 26 consisting of a sheet steel plate substantially of octagonal shape the edges 26*a* of which are straight while the edges 26*b* follow the contour of the straight connection length between the internal bands 12*c* of the base frame 12. Furthermore, both ends of the edges 26*a* are provided with edges 26*c* folded downwards and abutting against the bands 12*c* for retaining purposes. The covering plates 26 are provided with holes 27 coaxial with holes 28 of the base frame 12 in order to receive screws or the like to secure the covering plate 26 to the base frame 12.

It is self evident that if a window or door opening is to be provided in the wall, the covering plates 26 will be modified accordingly for the matching thereof to two or three bricks.

We claim:

1. A framework block or brick of sheet steel or aluminum which is press formed, which has the shape of a rectangular parallelepiped, which is of a modular framework structure, and which is formed by elements placed along the corners and the diagonals of the parallelepiped, comprising:

(a) two identical component elements having the shape of rectangular pyramids disposed with opposite vertices and the bases of which are the external facing surfaces of the block or brick; and (b) four angle bars having a C-cross section and forming the corners perpendicular to the external facing surfaces, wherein each of said component elements includes a base frame and two V-shaped elements or ribs which form the corners of the pyramid and extend and intersect such that each V-shaped element forms a pair of opposite semidiagonals having a first flattened end for connection to the base frame at the corners thereof and a second flattened end corresponding to the vertex of the pyramid for connection to each other, the connections being made by fastening means.

2. The framework block or brick according to claim 1, wherein said base frame comprises:

(a) an overturned U-section having a first, central band defining the facing surface of the brick;

(b) a second, external longitudinal band and a third, internal longitudinal band both at right angles with the first band, the third, internal band having a length less than the second, external band.

3. The framework block or brick according to claim 1, wherein each of said angle bars comprises:

two longitudinal flanges extending with edge portions which are parallel to said flanges but offset inwardly, and wherein longitudinal cuts are provided in the transit regions of each angle bar between said flanges and their edge portions, said cuts having a depth at least the same as the width of said third external band of said base frame, said edge portions extending at the upper and the lower sides with tabs, each of which are bent at right angles inwardly and are provided with a hole designed to align with a corresponding hole in said first, central band of the base frame and to receive the fastening means to secure said angle bars to the base frame.

4. The framework block or brick according to claim 1, wherein holes are formed longitudinally at predetermined distances along said flanges of said angle bars in order to receive the fastening means to secure the blocks to one another.

5. The framework block or brick according to claim 1, wherein formed covering plates are provided to cover and to shield the joint regions among the bricks and to join the corner regions of the bricks, said plates being formed so as to follow the contour of the corner regions among the connected bricks and being provided with folded edges for retaining the connected bricks and with holes coaxial with the holes formed in the underlying base frame.

* * * * *